US005765420A

United States Patent [19]

Schaefer

[11] Patent Number: 5,765,420

[45] Date of Patent: Jun. 16, 1998

[54] PROCESS AND APPARATUS FOR PRODUCING HOLLOW BODIES HAVING AT LEAST ONE BRANCH

[75] Inventor: August Wilhelm Schaefer, Drolshagen, Germany

[73] Assignee: Wilhelm Schaefer Maschinenbau GmbH & Co., Germany

[21] Appl. No.: 689,933

[22] Filed: Aug. 15, 1996

[30] Foreign Application Priority Data

Aug. 16, 1995 [DE] Germany ..... 195 30 056.4

[51] Int. Cl.[6] ..... B21D 26/02; B21D 28/18

[52] U.S. Cl. ..... 72/55; 72/58; 83/53; 83/54

[58] Field of Search ..... 72/55, 56, 57, 72/58, 60, 62; 83/53, 54

[56] References Cited

U.S. PATENT DOCUMENTS

| | | | |
|---|---|---|---|
| 2,238,037 | 4/1941 | Cornell, Jr. | 72/58 |
| 3,487,668 | 1/1970 | Fuchs, Jr. | 72/58 |
| 4,492,103 | 1/1985 | Naumann . | |
| 4,989,482 | 2/1991 | Mason | 72/55 |
| 5,398,533 | 3/1995 | Shimanovski et al. | 72/55 |
| 5,435,163 | 7/1995 | Schafer . | |
| 5,445,001 | 8/1995 | Snavely . | |
| 5,460,026 | 10/1995 | Schafer | 72/55 |

FOREIGN PATENT DOCUMENTS

| | | | |
|---|---|---|---|
| 1552122 | 10/1971 | Germany . | |
| 4035625 | 5/1992 | Germany . | |
| 7475 | 4/1969 | Japan | 72/58 |
| 820976 | 4/1981 | U.S.S.R. | 72/55 |
| 1306617 | 4/1987 | U.S.S.R. | 72/58 |
| 2 193 910 | 2/1988 | United Kingdom . | |
| 2 279 602 | 1/1995 | United Kingdom . | |
| 2 283 931 | 5/1995 | United Kingdom . | |

OTHER PUBLICATIONS

"Aufweitstauchen von Rohren Durch Innenhochdruckumformung", Dr.-Ing. Friedrich Kloss, Blech Rohre Profile, 35 (1988) 3, p. 175.

U.K. Patent Office Search Report, dated Sep. 24, 1996, for corresponding U.K. Patent Application No. GB 9616955.2.

*Primary Examiner*—David Jones
*Attorney, Agent, or Firm*—Harness, Dickey & Pierce P.L.C.

[57] ABSTRACT

A process for producing a hollow body provided with a transverse branch, in a forming tool from a tubular metal section, which process uses an internal high pressure forming technique. The process provides for the crown of the branch to be punched out by a platen (which supports the branch during its formation), at an internal pressure which is higher than the maximum production internal pressure (Pilmax). The end face of the platen at its head end is for this purpose of a larger dimension than the active supporting face and has a cutting edge which peripherally surrounds the active supporting face, in the manner of a collar.

4 Claims, 3 Drawing Sheets

PROCESS AND APPARATUS FOR PRODUCING HOLLOW BODIES HAVING AT LEAST ONE BRANCH

FIELD OF THE INVENTION

The invention relates to a process and to an apparatus for producing a hollow body provided with at least one branch, produced in a forming tool from a tubular metal section by an internal high pressure forming process. In such a process, the branch assumes an intermediate bulge-like shape before formation is completed. The bulge may be dome-like.

BACKGROUND OF THE INVENTION

One known form of internal high pressure forming process can be divided into three basic processes: partial swelling in the closed tool, rotationally symmetrical flaring in the closed tool and rotationally symmetrical flaring upsetting in the opened tool. As is known, in the case of one internal high pressure forming process a tubular section, for example made of steel or copper, is inserted into a multi-part internal high pressure forming tool without a fixed internal die, but with forming rams and an internal high pressure source. After the ends of the tubular section have been closed off by the forming rams, the tubular section is flared with the aid of a suitable pressurized medium and at the same time is laid against the inside wall of the forming tool, which has the final shape of the hollow body.

In the production of T-shaped hollow bodies, or other hollow bodies having at least one branch, a platen which upwardly limits the formation of a neck to the length desired for the finished part acts in opposition to a bulge, which is formed in the appropriately designed forming tool under the prevailing internal pressure, is shaped out of the inserted tubular section and becomes the branch. The shaped piece constructed in this way to have at least one branch, or the finished hollow body, must be removed from the tool after the internal high pressure forming. After this, it is necessary in additional operating steps to sever the crown of bulge (for example by plasma or laser cutting or sawing) and finally to carry out edge machining along the severing line.

The object of the invention is therefore to provide a process and an apparatus of the type mentioned at the outset by means of which hollow bodies (finished parts) having at least one branch (such as T-shaped pieces), may be produced more simply and in particular at considerably less expense.

SUMMARY OF THE INVENTION

As far as such a process is concerned, the above object is achieved in that the bulge crown is punched out by the platen supporting the crown which is created during forming, at an internal pressure which is higher than the maximum production internal pressure. Here, the invention is based on the idea of using the platen or counterpunch, which conventionally serves only to support the bulge, for punching out the bulge crown at the same time. An additional operating step is no longer necessary because punching out of the crown takes place in the internal high pressure forming tool, which is moreover not opened after the flaring upsetting procedure.

A platen which at the same time serves for punching out must have a cutting edge. However, in the case of conventional internal high pressure forming, this would necessarily result in undesirably cutting into the bulge forming a neck under the internal pressure, so that in fact a platen has been considered to rule itself out from use as a punching tool at the same time. However, in this respect the invention provides a remedy in a surprisingly simple manner, in that the punching out is carried out at an internal pressure which is higher than the maximum production internal pressure, for example at 800 bar instead of a 700 bar production internal pressure. The basis here is the realization that when the bulge forms a neck a quite specific crown configuration is produced as a result of the flow properties of the material; in fact, a radius is created in the region of transition to the substantially horizontal end face of the bulge crown which upwardly terminates the bulge and is actively supported by the platen. The term "active supporting face", incidentally, is used to mean only that end face section of the platen which comes to bear against the crown during the holding operation. Because the maximum production internal pressure is lower than the internal pressure during punching out, the cutting edge which is situated radially beyond the crown during the formation of a neck in the region of the transition radius does not come into contact with the material of the bulge, more precisely in the region of the transition radius, until the higher internal pressure has been set. The supply of pressurized medium is connected to a correspondingly controllable source of pressurized medium. In fact, it is only the higher internal pressure which brings the material of the crown transition radius, which is distributed or spread to below the cutting edge, into contact with the cutting edge. Because of the material flowing below the cutting edge, the transition radius is made smaller, with the cutting edge of the platen penetrating into the branch, first cutting into the crown and then, as the platen attached to an advancing means is acted upon further, completely punching out the crown.

The punching out of the crown described above thus differs substantially from the radial punching out of apertures in the wall of a finished hollow body known in the internal high pressure forming process (cf. DE-C-43 22 063). Apart from the fact that the known punching-out processes require additional supporting rams with specially shaped forming tools or separately operating piercing punches, these punching-out actions have hitherto only been carried out in the cylindrical wall of the tubular section.

A preferred embodiment of the invention provides for an internal dimension of the branch to be adjusted to a predetermined calibre at the same time as the punching-out procedure. This gives the platen a multi-functional use, since in addition to its actual purpose of use, supporting the crown, it furthermore ensures that the crown is punched out and the calibre of the branch is set, so that after the forming tool has been opened a finished part requiring no additional or further machining is found.

In the case of a platen preferred for carrying out the process, in accordance with the invention the end face of the platen at the head end is of a larger dimension than the active supporting face and is constructed to have a cutting edge which surrounds the active supporting face at a spacing peripherally, in the manner of a collar. Ibis ensures reliably that during the internal high pressure forming the cutting edge of the platen will not strike against the crown and cut into the latter undesirably early, which would produce disadvantages for the shaping of the finished part.

An embodiment of the invention provides for the platen head having the cutting edge to be provided at its outer periphery with a calibre-controlling bead. This convexly curved bead is dimensioned such that, when it penetrates into the bulge, after the crown of the latter has been punched out, it places or pushes away to the outside excess residual material remaining at the severed edge on the transition radius because of the severing cut, and thus ensures uniform smoothing of the inside wall of the branch.

Further details and advantages of the invention emerge from the claims and the description which follows, in which an embodiment of the subject of the invention is explained in more detail by way of example and with reference to the accompanying drawings.

DETAILED DESCRIPTION OF A PREFERRED EMBODIMENT

Figure 1:
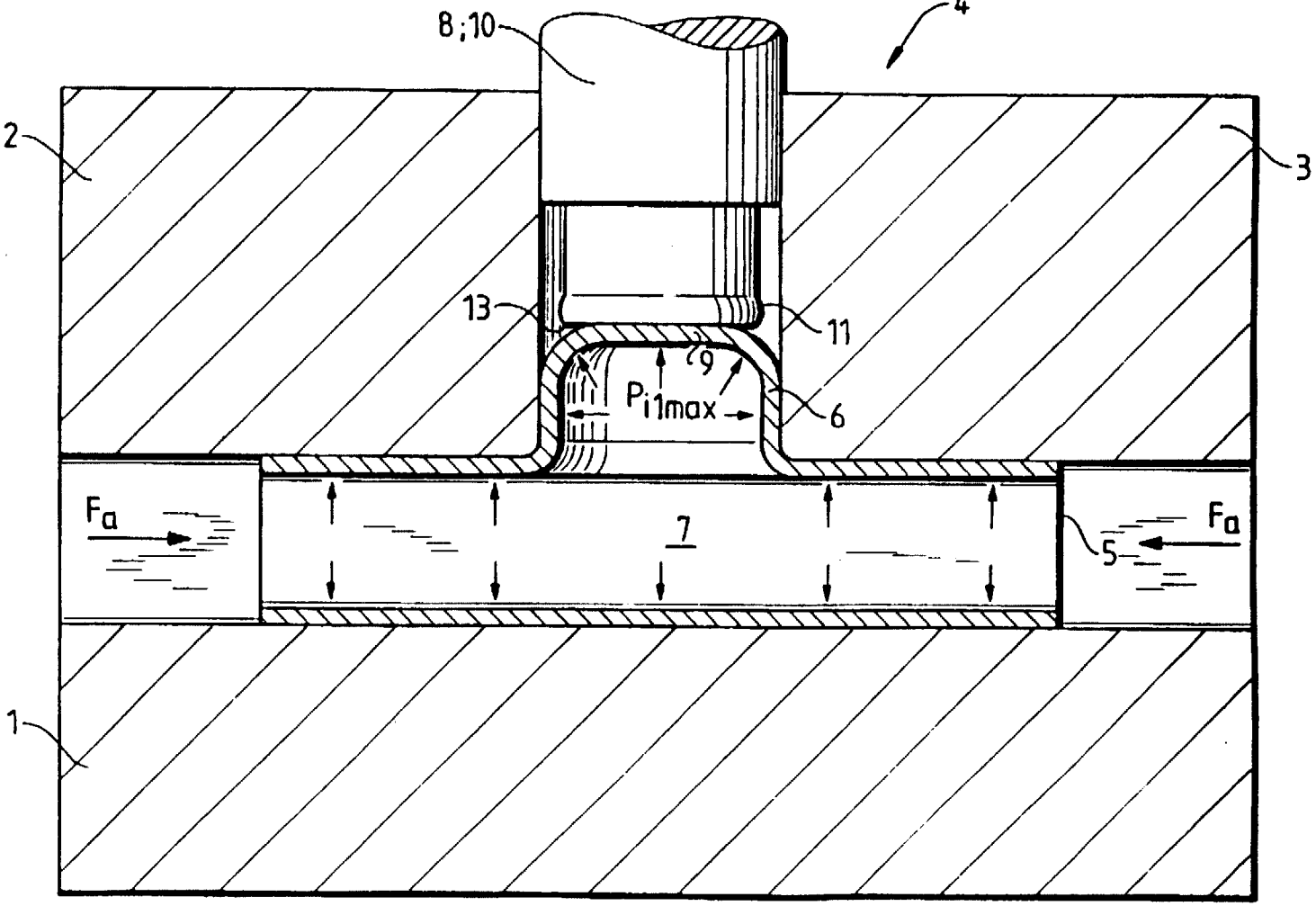
FIG. 1 shows, as a detail, a forming tool of an internal high pressure forming machine which is not shown in more detail and which is sufficiently known per se, illustrated in longitudinal section.

FIG. 1 shows a hollow body 5 which in the example embodiment is T-shaped and is produced by an internal high pressure forming process from a tubular section inserted in the tool parts 1, 2, 3 of a forming tool 4 of a forming machine (not illustrated). The forming rams, which during flaring upsetting on the one hand close the open ends of the tubular section and on the other hand press in the material for the bulge 6 creating a neck, are not illustrated and are merely characterized by the axial force Fa applied thereby. The pressurized medium is introduced into the interior 7 of the hollow body by way of at least one of the forming rams, which operate in opposition to one another. At the thus prevailing internal pressure Pilmax (cf. also the pressure arrows without references), the bulge 6 is created between the two tool parts 2, 3. The formation of the bulge 6 is upwardly limited by a platen 8 which acts between the tool parts 2, 3 and—supporting the bulge 6—bears against the bulge crown 9.

Figure 2A:
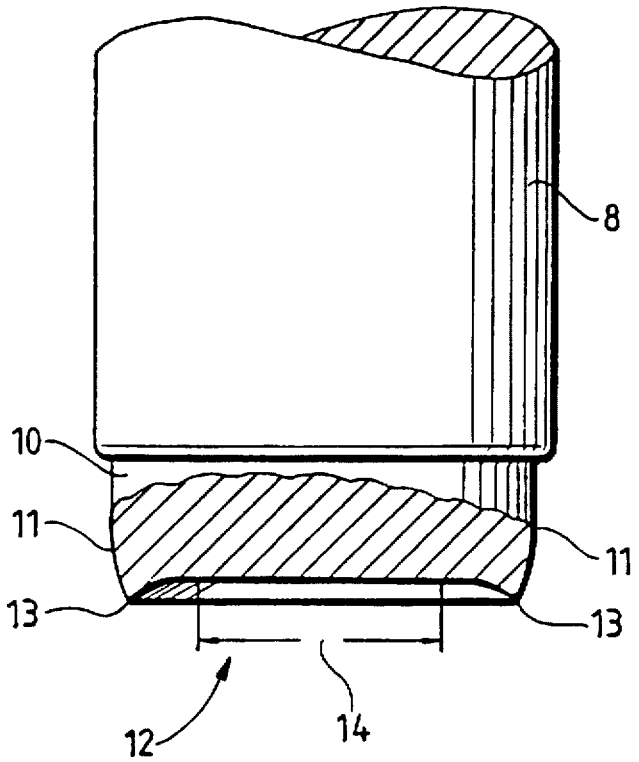
FIGS. 2*a*, 2*b* show, as a detail, the front end of a platen, illustrated in partial section (FIG. 2*a*) and seen from the end face (FIG. 2*b*)
Figure 2B:
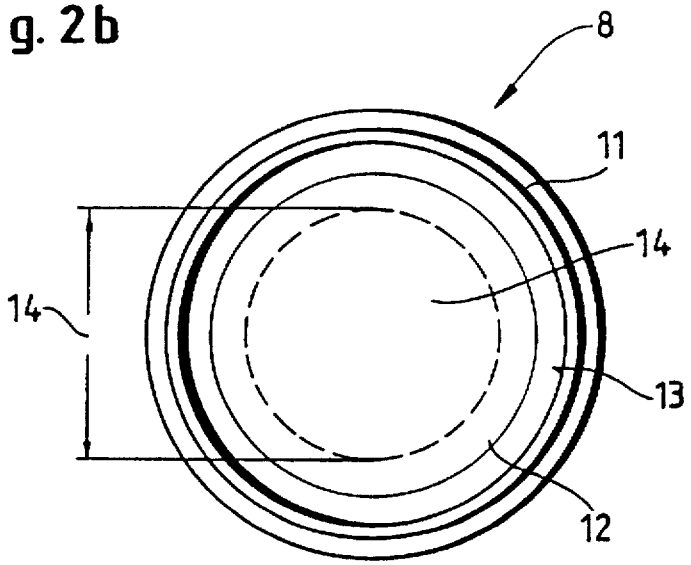

The platen 8—as can be seen in more detail from FIGS. 2*a*, 2*b*—has a head 10 which is constructed to have a calibre-controlling bead 11 on its outer periphery and a cutting edge 13 on its end face 12, this cutting edge 13 peripherally surrounds the active supporting face 14 in the manner of a collar, as indicated in dashed lines in FIG. 2*b*. The active supporting face 14 signifies the part of the platen head 10 which bears against the substantially horizontal planar section of the crown 9.

Figure 3A:
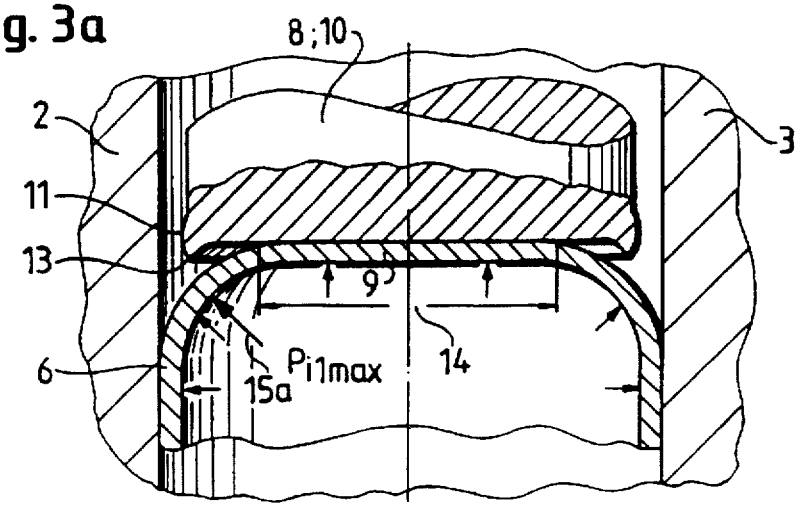
FIGS. 3*a*, 3*b*, 3*c* show, as a detail, different operating steps during the creation of the branch of a tubular section, namely at the maximum production internal pressure (FIG. 3*a*), at the beginning of punching out the bulge crown (FIG. 3*b*), and during smoothing of the branch inside wall (FIG. 3*c*), illustrated diagrammatically in partial section.
Figure 3B:
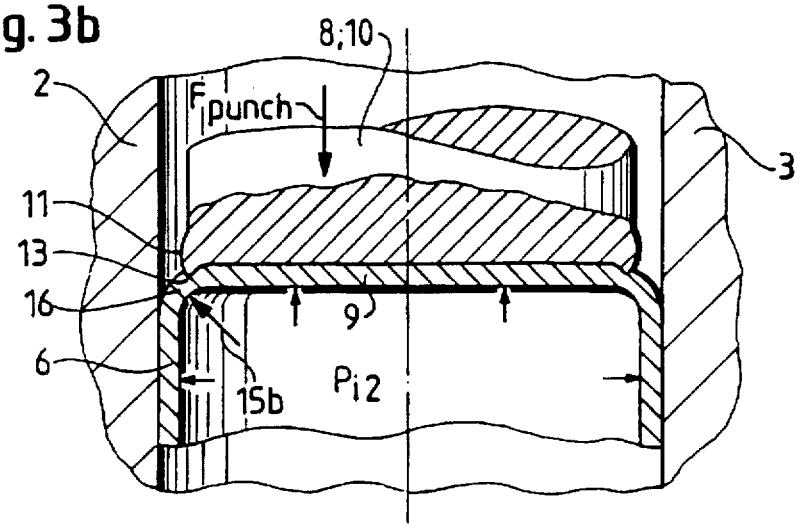
Figure 3C:
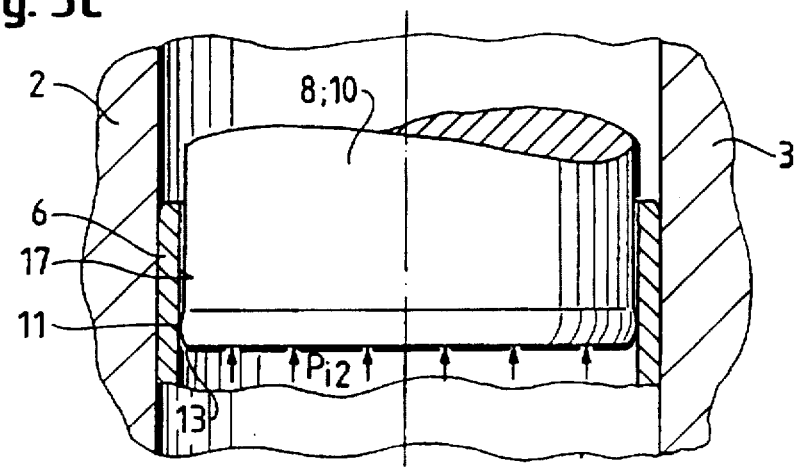

As can be seen from FIGS. 3*a* to 3*c*, illustrating individual operating phases, during formation of the tubular section to give the T-shaped finished hollow body 5 (cf. FIG. 1), the platen fulfills exclusively its normal function, i.e. supporting the bulge crown 9 by means of the active supporting face 14 (cf. FIG. 3*a*). The cutting edge 13 runs outside the active supporting face 14, that is to say at a spacing next to it, above the transition radius 15*a*, which is almost the shape of a circle quadrant and is formed under the maximum production internal pressure Pilmax between the upright wall of the branch 6 and the bulge crown 9. The cutting edge 13 does not come into contact with the neck-forming material of the bulge 6.

As soon as the bulge is completed (cf. FIG. 1), the internal pressure is increased to Pi2, in accordance with FIG. 3*b*, with the material of the bulge 6 being flared out of the transition radius 15*a* beyond the active supporting face 14 and filling the end face 12 of the platen head 10 up as far as the cutting edge 13 surrounding the supporting face 14 in the manner of a collar. The transition radius is correspondingly reduced to the remaining radius 15*b*, in accordance with FIG. 3*b*, and the cutting edge 13 cuts into the crown 9. Finally, the crown 9 is completely severed by the advance $F_{punch}$, of the plate 8; consequently, only the punched-out open branch 6 remains on the finished hollow body 5. In the course of further advance of the platen 8 the latter penetrates, in accordance with FIG. 3*c*, into the branch, pushing away by means of its bead II the inwardly projecting overhang 16 (cf. FIG. 3*b*) which remains after severing from the remaining radius 15*b*, and smoothing the inside wall 17 of the branch 6 as a whole. This smoothing takes place largely without loss of pressure, that is to say the increased pressure Pi2 continues to prevail.

As a result of the construction of the end face of the platen head 10, matched to the pressure conditions in the interior of the hollow body, with an active supporting face 14 and a cutting edge 13, it is thus possible in a single stroke following the forming, to immediately punch out the crown 9, and because of the bead 11 created on the outer periphery of the platen head 10 it is thus furthermore possible immediately to smooth the inside wall 17 of the branch 6, eliminating overhangs remaining from the punching procedure.

What is claimed:

1. A process for producing a hollow body from a tubular metal section, which hollow body comprises a first tubular body section having a longitudinal axis, and an integral tubular branch section generally transverse to said longitudinal axis, said process comprising the steps of:

subjecting said tubular metal section to an internal high pressure forming step at a first internal pressure, said internal high pressure forming step operable to form a bulge, including a crown, on said first body section;

wherein said internal high pressure forming step includes employing a forming tool comprising a platen, which platen supports said crown during said high pressure step; and subjecting said first body section to a punching step at a second internal pressure which is higher than said first internal pressure of said forming step, during which punching step said platen punches out an end part of said crown from said bulge to form said branch.

2. A process according to claim 1, wherein said branch includes an internal dimension and said punching step comprises adjusting said internal dimension of said branch.

3. An apparatus for producing a hollow body comprising a first tubular body section having a longitudinal axis, and an integral tubular branch section generally transverse to said longitudinal axis, from a tubular metal section comprising:

a forming tool including a platen, wherein said platen includes a head end comprising an end face operable for addressing a bulge crown formed within said tubular body section;

said head end further comprising an active supporting face, which head end supports the crown;

said end face of said platen being of a larger dimension than said active supporting face and comprising a cutting edge, which surrounds said active supporting face peripherally.

4. An apparatus according to claim 3, wherein said platen head comprises an outer periphery, which outer periphery is provided with a bead for adjusting an internal dimension of said branch during said production of said hollow body.

* * * * *